US008220394B2

(12) United States Patent
Bates et al.

(10) Patent No.: US 8,220,394 B2
(45) Date of Patent: Jul. 17, 2012

(54) OIL WELL PERFORATORS

(75) Inventors: Leslie Raymond Bates, Tonbridge (GB); Brian Bourne, Sevenoaks (GB)

(73) Assignee: Qinetiq Limited (GB)

( * ) Notice: Subject to any disclaimer, the term of this patent is extended or adjusted under 35 U.S.C. 154(b) by 407 days.

(21) Appl. No.: 10/574,999

(22) PCT Filed: Oct. 8, 2004

(86) PCT No.: PCT/GB2004/004256
§ 371 (c)(1),
(2), (4) Date: Apr. 7, 2006

(87) PCT Pub. No.: WO2005/035939
PCT Pub. Date: Apr. 21, 2005

(65) Prior Publication Data

US 2007/0056462 A1 Mar. 15, 2007

(30) Foreign Application Priority Data

Oct. 10, 2003 (GB) ..... 0323717.9

(51) Int. Cl.
*F42B 1/02* (2006.01)
*F42B 1/032* (2006.01)

(52) U.S. Cl. ..... 102/476; 102/306

(58) Field of Classification Search ..... 102/301, 102/306, 312, 313, 476
See application file for complete search history.

(56) References Cited

U.S. PATENT DOCUMENTS 2,972,948 A 2/1961 Kray
(Continued)

FOREIGN PATENT DOCUMENTS

DE 2 306 872 8/1974
(Continued)

OTHER PUBLICATIONS

Fischer et al., "A Survey of Combustible Metals, Thermites, and Intermetallics for Pyrotechnic Applications", published by Sandia National Laboratories (SAND 95-2448C), presented at AIAA/ASME/SAE/ASEE Joint Propulsion Conference, Lake Buena Vista, FL, Jul. 1-3, 1996, pp. 1-13.

(Continued)

*Primary Examiner* — David Parsley
(74) *Attorney, Agent, or Firm* — McDonnell Boehnen Hulbert & Berghoff LLP

(57) ABSTRACT

An oil and gas well shaped charge perforator capable of providing an exothermic reaction after detonation is provided, comprising a housing, a high explosive, and a reactive liner where the high explosive is positioned between the reactive liner and the housing. The reactive liner is produced from a composition which is capable of sustaining an exothermic reaction during the formation of the cutting jet. The composition may be selected from any known formulation which is suitable for use in an oil and gas well perforator, typically the composition will comprise at least one metal and at least one non-metal, wherein the non-metal is selected from a metal oxide, or any non-metal from Group III or Group IV or at least two metals such as to form an intermetallic reaction. Typically at least one of the metals in the invention may be selected from Al, Ce, Li, Mg, Mo, Ni, Nb, Pb, Pd, Ta, Ti, Zn or Zr. The liner composition may preferably be a pressed particulate composition, such that the material is consolidated under pressure to form the desired shape of the liner. To aid consolidation a binder may also be added.

28 Claims, 1 Drawing Sheet

U.S. PATENT DOCUMENTS

| | | | | | |
|---|---|---|---|---|---|
| 3,235,005 | A | | 2/1966 | Delacour | |
| 3,675,575 | A | | 7/1972 | Bailey et al. | |
| 4,702,171 | A | * | 10/1987 | Tal et al. | 102/476 |
| 4,766,813 | A | * | 8/1988 | Winter et al. | 102/307 |
| 5,083,615 | A | | 1/1992 | McLaughlin et al. | |
| 5,212,343 | A | | 5/1993 | Brupbacher et al. | |
| 6,012,392 | A | * | 1/2000 | Norman et al. | 102/307 |
| 6,021,714 | A | * | 2/2000 | Grove et al. | 102/307 |
| 6,371,219 | B1 | * | 4/2002 | Collins et al. | 175/2 |
| 6,446,558 | B1 | * | 9/2002 | Peker et al. | 102/306 |
| 7,278,353 | B2 | | 10/2007 | Langan et al. | |
| 7,278,354 | B1 | | 10/2007 | Langan et al. | |
| 2002/0017214 | A1 | * | 2/2002 | Jacoby et al. | 102/307 |
| 2002/0112564 | A1 | | 8/2002 | Leidel et al. | |
| 2003/0037692 | A1 | | 2/2003 | Liu | |
| 2003/0037693 | A1 | | 2/2003 | Wendt et al. | |
| 2004/0020397 | A1 | * | 2/2004 | Nielson et al. | 102/476 |
| 2004/0255812 | A1 | * | 12/2004 | Bourne et al. | 102/476 |

FOREIGN PATENT DOCUMENTS

| | | |
|---|---|---|
| EP | 1 348 683 | 10/2003 |
| GB | 839872 | 6/1960 |
| GB | 2 295 664 | 6/1996 |

OTHER PUBLICATIONS

Jacobi et al, "Optical Properties of Ternary β Electronphases based on NiAIJ", J. Phys. Chem. Solids, 1973, vol. 34, pp. 1737-1748. Pergamon Press. Printed in Great Britain.

Jacobi et al., "Electrical Properties of β-Phase NiAI" , J. Phys. Chem. Solids Pergamon Press 1969. vol. 30,~~. 1261-1271. Printed in Great Britain.

Massalski et al., "Electronic Structures of Hume-Rothery Phases", Progress in Materials Science, 1978 vol. 22 pp. 151-155.

Alexander Hardt, Incendiary Potential of Exothermic Intermetallic Reactions, Lockheed Palo Alto Research Laboratory, Technical Report AFATL-TR-71-87, Jul. 1971.

* cited by examiner

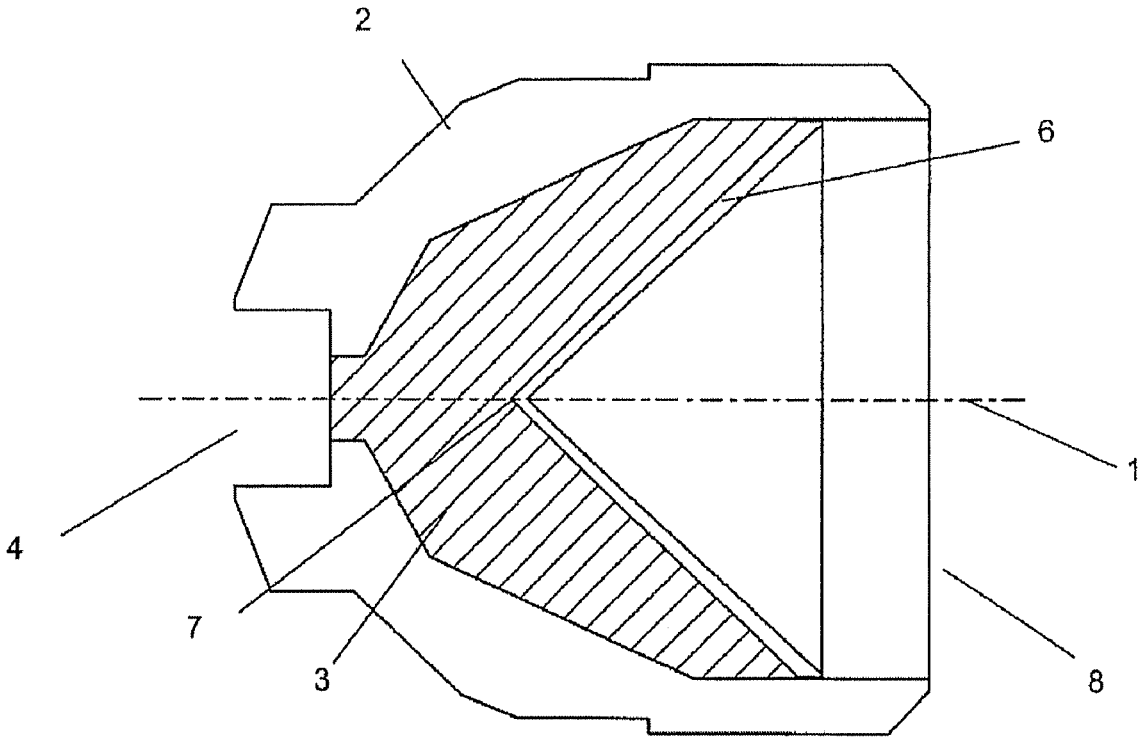
2
6
1
4
7
3
8

OIL WELL PERFORATORS

FIELD OF THE INVENTION

The present invention relates to a reactive shaped charge liner for a perforator for use in perforating and fracturing well completions.

BACKGROUND TO THE INVENTION

By far the most significant process in carrying out a completion in a cased well is that of providing a flow path between the production zone, also known as a formation, and the well bore. Typically, the provision of such a flow path is carried out by using a perforator, initially creating an aperture in the casing and then penetrating into the formation via a cementing layer, this process is commonly referred to as a perforation. Although mechanical perforating devices are known, almost overwhelmingly such perforations are formed using energetic materials, due to their ease and speed of use. Energetic materials can also confer additional benefits in that they may provide stimulation to the well in the sense that the shockwave passing into the formation can enhance the effectiveness of the perforation and produce an increased flow from the formation. Typically, such a perforator will take the form of a shaped charge. In the following, any reference to a perforator, unless otherwise qualified, should be taken to mean a shaped charge perforator.

A shaped charge is an energetic device made up of a housing within which is placed a typically metallic liner. The liner provides one internal surface of a void, the remaining surfaces being provided by the housing. The void is filled with an explosive which, when detonated, causes the liner material to collapse and be ejected from the casing in the form of a high velocity jet of material. This jet impacts upon the well casing creating an aperture, the jet then continues to penetrate into the formation itself, until the kinetic energy of the jet is overcome by the material in the formation. The liner may be hemispherical but in most perforators is generally conical. The liner and energetic material are usually encased in a metallic housing, conventionally the housing will be steel although other alloys may be preferred. In use, as has been mentioned the liner is ejected to form a very high velocity jet which has great penetrative power.

Generally, a large number of perforations are required in a particular region of the casing proximate to the formation. To this end, a so called gun is deployed into the casing by wireline, coiled tubing or indeed any other technique known to those skilled in the art. The gun is effectively a carrier for a plurality of perforators that may be of the same or differing output. The precise type of perforator, their number and the size of the gun are a matter generally decided upon by a completion engineer based on an analysis and/or assessment of the characteristics of the completion. Generally, the aim of the completion engineer is to obtain an appropriate size of aperture in the casing together with the deepest possible penetration into the surrounding formation. It will be appreciated that the nature of a formation may vary both from completion to completion and also within the extent of a particular completion. In many cases fracturing of the perforated substrate is highly desirable.

Typically, the actual selection of the perforator charges, their number and arrangement within a gun and indeed the type of gun is decided upon by the completion engineer. In most cases this decision will be based on a semi-empirical approach born of experience and knowledge of the particular formation in which the completion is taking place. However, to assist the engineer in his selection there have been developed a range of tests and procedures for the characterisation of an individual perforator's performance. These tests and procedures have been developed by the industry via the American Petroleum Institute (API). In this regard, the API standard RP 19B (formerly RP 43 $5^{th}$ Edition) is used widely by the perforator community as indication of perforator performance. Manufacturers of perforators typically utilise this API standard marketing their products. The completion engineer is therefore able to select between products of different manufacturers for a perforator having the performance he believes is required for the particular formation. In making his selection, the engineer can be confident of the type of performance that he might expect from the selected perforator.

Nevertheless, despite the existence of these tests and procedures there is a recognition that completion engineering remains at heart more of an art than a science. It has been recognised by the inventors in respect of the invention set out herein, that the conservative nature of the current approach to completion has failed to bring about the change in the approach to completion engineering required, to enhance and increase production from both straightforward and complex completions.

There are a large number of widely known shaped charge designs, however many of the designs are merely incremental changes to the pressed density of the explosive or the cone angle of the liner. The largest area of development work has mainly concentrated on improving the penetration by the choice of metal liner, its shape, the casing, the type of high explosive and the methods of initiation of the high explosive. The kinetic energy of the jet from a shaped charge is provided exclusively by the detonative pressure of the explosive which forces the collapse of the liner. This in turn leads to the liner material being ejected at a high velocity. Once the jet is in motion there is no further energy available from the system.

In the past depleted uranium (du) shaped charges have been researched but their use is deemed controversial on environmental grounds even within a military context. Du is substantially uranium 238 with only about 0.3% of uranium 235. Apart from the superior penetrative power of du jets when compared with all other liner materials an additional advantage is that the jets may be regarded as being pyrophoric. This may provide some additional jet/target and/or target/behind armour benefits by imparting additional energy and causing additional damage to a target. This additional energy would be extremely useful in the oil and gas industry to fracture the substrates. However the use of a mildly radioactive substance in a commercial application such as an oil and gas perforation would not be considered appropriate.

Therefore it would be desirable to produce a shaped charge liner whose jet can provide additional energy after the detonative event, without the requirement of using a radioactive constituent.

SUMMARY OF THE INVENTION

Thus, in accordance with a first aspect of the invention, there is provided a reactive shaped charge liner, wherein the liner comprises a composition capable of an exothermic reaction upon activation of the shaped charge liner.

In order to achieve this exothermic output the liner composition preferably comprises at least two components which, when supplied with sufficient energy (i.e. an amount of energy in excess of the activation energy of the exothermic reaction) will react to produce a large amount of energy, typically in the form of heat. The exothermic reaction of the liner can be achieved by using a typically stoichiometric (molar) mixture of at least two metals which are capable upon activation of the shaped charge liner to produce an intermetallic product and heat. Typically the reaction will involve only two metals, however intermetallic reactions involving more than two metals are known. Alternatively, the liner composition may comprise at least one metal and at least one non-metal, where the non-metal may be selected from a metal oxide, such as copper oxide, molybdenum oxide or nickel oxide or any non-metal from Group III or Group IV, such as silicon, boron or carbon. Pyrotechnic formulations involving the combustion of reaction mixtures of fuels and oxidisers are well known. However a large number of such compositions, such as gunpowder for example, would not provide a suitable liner material, as they would not possess the required density or mechanical strength.

Below is a non-exhaustive list of elements that when combined and subjected to a stimulus such as heat or an electrical spark produce an exothermic reaction and which may be selected for use in a reactive liner:

Al and one of Li or S or Ta or Zr
B and one of Li or Nb or Ti
Ce and one of Zn or Mg or Pb
Cu and S
Fe and S
Mg and one of S or Se or Te
Mn and either S or Se
Ni and one of Al or S or Se or Si
Nb and B
Mo and S
Pd and Al
Ta and one of B or C or Si
Ti and one of Al or C or Si
Zn and one of S or Se or Te
Zr and either of B or C There are a number of compositions which contain only metallic elements and also compositions which contain metallic and non metallic elements, that when mixed and heated beyond the activation energy of the reaction, will produce a large amount of thermal energy as shown above and further will also provide a liner material of sufficient mechanical strength. Therefore the composition may comprise a metal selected from Al, Ce, Li, Mg, Mo, Ni, Nb, Pb, Pd, Ta, Ti, Zn or Zr, which are known to produce an exothermic event when mixed with other metals or non-metals, the combinations of which would be readily appreciated by those skilled in the art of energetic formulations. The preferred metal-metal compositions are nickel and aluminium or palladium and aluminium, mixed in stoichiometric quantities. It will be readily appreciated by those skilled in the art that ratios other than a stoichiometric ratio may also afford an exothermic reaction and as such the invention is not limited to stoichiometric mixtures. The liners give particularly effective results when the two metals are provided in respective proportions calculated to give an electron concentration of 1.5, that is a ratio of 3 valency electrons to 2 atoms such as NiAl or PdAl as noted above.

By way of example an important feature of the invention is that NiAl reacts only when the mixture experiences a shock wave of >~14 Gpa. This causes the powders to form the intermetallic NiAl with a considerable out put of energy.

There are a number of intermetallic alloying reactions that are exothermic and find use in pyrotechnic applications. Thus the alloying reaction between aluminium and palladium releases 327 cals/g and the aluminium/nickel system, producing the compound NiAl, releases 329 cals/g (2290 cals/cm$^3$). For comparison, on detonation TNT gives a total energy release of about 2300 cals/cm$^3$ so the reaction is of similar energy density to the detonation of TNT, but of course with no gas release. The heat of formation is about 17000 cal/mol at 293 degrees Kelvin and is clearly due to the new covalent bonds formed between two dissimilar metals. In a shaped charge this energy is generated in the jet and is available to be dumped into the target substrate causing more damage in the target when compared with non reactive jets.

The Pd/Al system can be used simply by swaging palladium and aluminium together in wire or sheet form, but Al and Ni only react as a powder mixture.

Palladium, however, is a very expensive platinum group metal and therefore the nickel-aluminium has significant economic advantages. An empirical and theoretical study of the shock-induced chemical reaction of nickel/aluminium powder mixtures has shown that the threshold pressure for reaction is about 14 Gpa. This pressure is easily obtained in the shock wave of modern explosives used in shaped charge applications and so Ni/Al can be used as a shaped charge liner to give a reactive, high temperature jet. The jet temperature has been estimated to be 2000 degrees Kelvin. The effect of the particle sizes of the two component metals on the properties of the resultant shaped charge jet is an important feature to obtain the best performance.

Micron and Nanometric size aluminium and nickel powders are both available commercially and their mixtures will undergo a rapid self-supporting exothermic reaction. A hot Ni/Al jet should be highly reactive to a range of target materials, hydrated silicates in particular should be attacked vigorously. Additionally, when dispersed after penetrating a target in air the jet should subsequently undergo exothermic combustion in the air so giving a blast enhancement or behind armour effect.

For some materials like PdAl the desired reaction from the shaped charge liner may be obtained by forming the liner by cold rolling sheets of the separate materials to form the composition which can then be finished by any method including machining on a lathe. PdAl liners may also be prepared by pressing the composition to form a green compact In the case of AlNi the reaction will only occur if liner is formed from a mixture of powders that are green compacted It will be obvious that any mechanical or thermal energy imparted to the reactive material during the formation of the liner must be taken into consideration so as to avoid an unwanted exothermic reaction. In the case of pressing to form a green compacted liner a binder may be required, which can be any powdered metal or non-metal material Preferably the binder comprises a polymeric material, such as a stearate, wax or epoxy resin. Alternatively the binder may be selected from an energetic binder such as Polyglyn (Glycidyl nitrate polymer), GAP (Glycidyl azide polymer) or Polynimmo (3-nitratomethyl-3-methyloxetane polymer). The binder may also be selected from lithium stearate or zinc stearate. Conveniently, at least one of the metals which is to form part of the composition may be coated with one of the aforementioned binder materials. Typically the binder, whether it is being used to pre-coat a metal or is mixed directly into the composition containing a metal, may be present in the range of from 1% to 5% by mass.

When a particulate composition is to be used, the diameter of the particles, also referred to as 'grain size', play an important role in the consolidation of the material and therefore affects the pressed density of the liner. It is desirable for the density of the liner to be as high as possible in order to produce a more effective hole forming jet. It is desirable that the diameter of the particles is around 1 to 10 μm, but particles of 1 μm or less in diameter, and even nano scale particles may be used. Materials referred to herein with particulate sizes less than 0.1 μm are referred to as "nano-crystalline materials".

Advantageously, if the particle diameter size of the metal or metals such as nickel and aluminium or palladium and aluminium in the composition of a reactive liner is less than 10 microns, and even more preferably less than 1 micron, the reactivity and hence the rate of exothermic reaction of the liner will be significantly increased, due to the large increase in surface area. Therefore, a composition formed from readily available materials, such as those disclosed earlier, may provide a liner which possesses not only the kinetic energy of the cutting jet, as supplied by the explosive, but also the additional thermal energy from the exothermic chemical reaction of the composition, thus providing a more energetic and safer alternative to dU.

At particle diameter sizes of less than 0.1 microns the compositions become increasingly attractive as a shaped charge liner material due to their even further enhanced exothermic output on account of the extremely high relative surface area of the reactive compositions.

The liner thickness may be selected from any known or commonly used wall liner thickness. The liner wall thickness is commonly expressed in relation to the diameter of the base of the liner and is preferably selected in the range of from 1 to 10% of the liner diameter, more preferably in the range of from 1 to 5% of the liner diameter. In one arrangement the liner may possess walls of tapered thickness, such that the thickness at the liner apex is reduced compared to the thickness at the base of the liner or alternatively the taper may be selected such that the apex of the liner is substantially thicker than the walls of the liner towards its base. A yet further alternative is where the thickness of the liner is not uniform across its surface area, such as to produce a non uniform taper or a plurality of protrusions and substantially void regions, to provide regions of variable thickness, which may extend fully or partially across the surface area of the liner, allowing the velocity and cutting efficiency of the jets to be selected to meet the conditions of the completion at hand.

The shape of the liner may be selected from any known or commonly used shaped charge liner shape, such as substantially conical or hemispherical.

In an alternative arrangement it may be desirable that the liner further comprises at least one further metal, where the at least one further metal does not participate in the exothermic reaction when the shaped charge is activated. Consequently the additional metal is considered to be inert and may be selected from any commonly used or known shaped charge liner metal. The purpose of adding a further metal is to provide additional mechanical strength to the liner and thus to increase the penetrative power of the jet. The properties of tungsten and copper as shaped charge liners are well known and they are typically used as liner materials due to their high density and ductility, which traditionally make them desirable materials for this purpose. Therefore, it may further be desirable to incorporate a portion of either copper or tungsten or an alloy thereof, into the reactive liner of the invention in order to provide a reactive liner of increased strength and hence a more powerful jet. The inert metal may either be mixed and uniformly dispersed within the reactive composition or the liner may be produced such that there are 2 layers, with a layer of inert metal covered by a layer of the reactive liner composition, which could then be pressed by one of the aforementioned pressing techniques.

Ultra-fine powders comprising nano-crystalline particles can also be produced via a plasma arc reactor as described in PCT/GB01/00553 and WO 93/02787.

In another aspect, the invention comprises a shaped charge suitable for down hole use, comprising a housing, a quantity of high explosive and a liner as described hereinbefore, located within the housing, the high explosive being positioned between the liner and the housing.

In use the reactive liner imparts additional thermal energy from the exothermic reaction, which may help to further distress and fracture the completion. A yet further benefit is that the material of the reactive liner may be consumed such that there is no slug of liner material left in the hole that has just been formed, which can be the case with some liners.

Preferably the housing is made from steel although the housing could be formed partially or wholly from one of the reactive liner compositions by one of the aforementioned pressing techniques, such that upon detonation the case may be consumed by the reaction to reduce the likelihood of the formation of fragments.

The high explosive may be selected from a range of high explosive products such as RDX, TNT, RDX/TNT, HMX, HMX/RDX, TATB, HNS. It will be readily appreciated that any suitable energetic material classified as a high explosive may be used in the invention. Some explosive types are however preferred for oil well perforators, because of the elevated temperatures experienced in the well bore.

The diameter of the liner at the widest point, that being the open end, can either be substantially the same diameter as the housing, such that it would be considered as a full calibre liner or alternatively the liner may be selected to be sub-calibre, such that the diameter of the liner is in the range of from 80% to 95% of the full diameter. In a typical conical shaped charge with a full calibre liner the explosive loading between the base of the liner and the housing is very small, such that in use the base of the cone will experience only a minimum amount of loading. Therefore in a sub calibre liner a greater mass of high explosive can be placed between the base of the liner and the housing to ensure that a greater proportion of the base liner is converted into the cutting jet.

The depth of penetration into the completion is a critical factor in completion engineering, and thus it is usually desirable to fire the perforators perpendicular to the casing to achieve the maximum penetration, and as highlighted in the prior art typically also perpendicular to each other to achieve the maximum depth per shot. Alternatively in applicant's co-pending application it is desirable to locate and align at least two of the perforators such that the cutting jets will converge, intersect or collide at or near the same point.

The perforators as hereinbefore described may be inserted directly into any subterranean well, however it is usually desirable to incorporate the perforators into a gun, in order to allow a plurality of perforators to be deployed into the completion.

According to a further aspect of the invention there is provided a method of improving fluid outflow from a well comprising the step of perforating the well using at least one liner, perforator, or perforating gun according to the present invention. Fluid outflow is improved by virtue of improved perforations created.

BRIEF DESCRIPTION OF THE FIGURES

In order to assist in understanding the invention, a number of embodiments thereof will now be described, by way of example only and with reference to the accompanying drawing, in which:

FIG. 1 is a cross-sectional view along a longitudinal axis of a shaped charge device in accordance with an embodiment of the invention containing a partial apical insert

DETAILED DESCRIPTION

As shown in FIG. 1 a cross section view of a shaped charge, typically axi-symmetric about centre line 1, of generally conventional configuration comprises a substantially cylindrical housing 2 produced from a metal, polymeric, GRP or reactive material according to the invention. The liner 6 according to the invention, has a wall thickness of typically say 1 to 5% of the liner diameter but may be as much as 10% in extreme cases. The liner 6 fits closely in the open end 8 of the cylindrical housing 2. High explosive material 3 is located within the volume enclosed between the housing and the liner. The high explosive material 3 is initiated at the closed end of the device, proximate to the apex 7 of the liner, typically by a detonator or detonation transfer cord which is located in recess 4.

A suitable starting material for the liner comprises a stoichiometric mixture of 1 to 10 micron powdered nickel and aluminium with a 0.75 to 5% by weight of powdered binder material. The binder material comprises as described before. The nano-crystalline powder composition material can be obtained via any of the above mentioned processes.

Other examples of suitable intermetallic compounds may be derived by observing that the NiAl compound described above is one example of a compound which, when assigned the customary valencies, corresponds to a ratio of three valence electrons to two atoms: that is, an electron concentration of $3/2=1.5$. Both NiAl and PdAl are specific examples of intermetallic compounds which fall within this category and which exhibit the same crystalline structure, though other compounds having the same characteristic electron concentration could be used. Other candidate compounds in this category therefore include, for example, CuZn, Cu3Al, and Cu5Sn but not, for example, Ni2Al that does not have a ratio of three valence electrons to two atoms and is only a compound mixture. The specific choice of metals may be made according to weight and potential energy release of the specific compound.

The specific commercial choice of metals may also be influenced by cost and in that regard it is noted that both Ni and Al are both inexpensive and readily available as compared with some other candidate metals. In tests it has been found that use of NiAl has given particularly good results. Furthermore, the manufacturing process for liners of NiAl is also relatively simple.

One method of manufacture of liners is by pressing a measure of intimately mixed and blended powders in a die set to produce the finished liner as a green compact. In other circumstances according to this patent, different, intimately mixed powders may be employed in exactly the same way as described above, but the green compacted product is a near net shape allowing some form of sintering or infiltration process to take place.

Modifications to the invention as specifically described will be apparent to those skilled in the art, and are to be considered as falling within the scope of the invention. For example, other methods of producing a fine grain liner will be suitable

The invention claimed is:

1. A reactive, oil and gas well shaped charge perforator comprising a liner and an associated shaped charge, whereby the liner is a green compacted particulate composition formed from a powder mixture comprising at least two metal elements, and whereby the liner is reactive such that the at least two metal elements will undergo an intermetallic alloying reaction to give an exothermic reaction upon activation of the associated shaped charge, and in which the at least two metal elements are provided in respective proportions calculated to give an electron concentration of 1.5, and wherein the composition further comprises at least one further inert metal, wherein the at least one further inert metal is not capable of an exothermic reaction with the at least two metal elements upon activation of the shaped charge liner.

2. A liner according to claim 1 in which one of the metals is aluminium.

3. A liner according to claim 1 in which one of the metals is selected from nickel and palladium.

4. A liner according to claim 1, wherein a binder is added to aid consolidation.

5. A liner according to claim 1, wherein at least one of the metals is coated with a binder.

6. A liner according to claim 4, wherein the binder is selected from a polymer.

7. A liner according claim 6 wherein the binder is selected from a stearate, wax or epoxy resin.

8. A liner according to claim 6, wherein the polymer is an energetic polymer.

9. A liner according to claim 8, wherein the energetic binder is selected from Polyglyn (Glycidyl nitrate polymer), GAP (Glycidyl azide polymer) or Polynimmo (3-nitratomethyl-3-methyloxetane polymer).

10. A liner according to claim 4, wherein the binder is selected from lithium stearate or zinc stearate.

11. A liner according to claim 4, wherein the binder is present in the range of from 0.1 to 5% by mass.

12. A liner according to claim 1, wherein the composition of at least two metals is particulate, the particles having a diameter 10 μm or less.

13. A liner according to claim 12, wherein the particles are 1 μm or less in diameter.

14. A liner according to claim 13, wherein the particles are 0.1 μm or less in diameter.

15. A liner according to claim 1, wherein the thickness of liner is selected in the range of from 1 to 10% of the liner diameter.

16. A liner according to claim 15 wherein the thickness of liner is selected in the range of from 1 to 5% of the liner diameter.

17. A liner according to claim 1, wherein the thickness of the liner is non-uniform across the surface area of the liner.

18. A liner according to claim 1, wherein the at least one further metal is selected from copper, tungsten, or an alloy thereof.

19. A perforator comprising a housing, a quantity of high explosive located within the housing and a liner according to claim 1 located within the housing so that the high explosive is positioned between the liner and the housing.

20. A perforation gun comprising one or more shaped charge perforators according to claim 1.

21. A method of completing an oil or gas well using one or more shaped charge liners according to claim 1.

22. A method of completing an oil or gas well using a one or more shaped charge perforators, according to claim 1.

23. A method of completing an oil or gas well using one or more perforation guns according to claim 20.

24. A method of improving fluid outflow from a well comprising the step of perforating the well using one or more perforators according to claim 1.

25. A liner according to claim 1 wherein the composition of at least two metals is a stoichiometric composition of two metals.

26. A liner according to claim 1 in which one of the metals is selected from iron, molybdenum, nickel and palladium.

27. A liner according to claim 5 wherein the binder is selected from a polymer.

28. A reactive oil and gas well shaped charge perforator comprising a liner and an associated shaped charge, whereby the liner is a green compacted particulate composition formed from a powder mixture comprising two metal elements, nickel and aluminium, and whereby the liner is reactive such that the two metal elements will undergo an intermetallic alloying reaction to give an exothermic reaction upon activation of the associated shaped charge, and in which the two metal elements are provided in respective proportions calculated to give an electron concentration of 1.5, thereby forming the intermetallic compound NiAl, and wherein the composition further comprises at least one further inert metal, wherein the at least one further inert metal is not capable of an exothermic reaction with the two metal elements upon activation of the shaped charge liner.

* * * * *